US005544433A

United States Patent [19]

Borsoi et al.

[11] Patent Number: 5,544,433

[45] Date of Patent: Aug. 13, 1996

[54] INNERBOOT FOR SPORTS SHOES

[75] Inventors: Bruno Borsoi, Vittorio Veneto; Ivan Martinazzo, Montebelluna, both of Italy

[73] Assignee: Nordica S.p.A., Trevignano, Italy

[21] Appl. No.: 422,574

[22] Filed: Apr. 14, 1995

[30] Foreign Application Priority Data

Jun. 24, 1994 [IT] Italy ..... TV94A0073

[51] Int. Cl.[6] ..... A43B 5/04; A43B 3/10

[52] U.S. Cl. ..... 36/117.7; 36/119.1; 36/10; 36/55; 36/115; 36/116

[58] Field of Search ..... 36/10, 55, 71, 36/117, 119

[56] References Cited

U.S. PATENT DOCUMENTS

| | | | |
|---|---|---|---|
| 3,786,580 | 1/1974 | Dalebout | 36/117 X |
| 4,301,564 | 11/1981 | Dalebout | 36/117 X |
| 4,723,364 | 2/1988 | Marxer | 36/10 |
| 5,279,052 | 1/1994 | Perotto et al. | 36/117 X |

FOREIGN PATENT DOCUMENTS

| | | | |
|---|---|---|---|
| 176154 | 9/1953 | Australia | 36/117 |
| 0278281 | 8/1988 | European Pat. Off. | 36/117 |
| 321474 | 1/1903 | France . | |
| 2434589 | 3/1980 | France . | |
| 2541095 | 8/1984 | France | 36/117 |
| 607268 | 12/1934 | Germany | 36/10 |
| 7115124 | 9/1971 | Germany . | |
| 9409663 | 5/1994 | WIPO . | |

*Primary Examiner*—Paul T. Sewell
*Assistant Examiner*—Marie Denise Patterson
*Attorney, Agent, or Firm*—Guido Modiano; Albert Josif

[57] ABSTRACT

An innerboot particularly for sports shoes which includes a first flap and a second flap in which the tips that are adjacent to the toe region are free and/or cannot mutually overlap. The first and second flaps can therefore mutually overlap in any direction so as to improve user fit.

11 Claims, 6 Drawing Sheets

INNERBOOT FOR SPORTS SHOES

BACKGROUND OF THE INVENTION

The present invention relates to an innerboot, particularly for sports shoes such as ski boots, roller skates, ice skates, shoes for climbing or shoes for snowboarding.

These conventional shoes comprise a shell made of rigid plastics and require, in order to increase the user's comfort, the insertion of an innerboot made of soft material.

For inserting the foot, the innerboot has a slit at the front tibial region of the foot instep and of the metatarsal region. The slit forms two flaps that can be moved apart to insert the foot and are then overlapped to allow to close the shoe.

The drawback of these conventional innerboots is essentially that the tips of the flaps are sewn together, usually proximate to the toe region, thus preventing any different mutual arrangement of the flaps that is required, for example, when the innerboot is to be associated with a shoe for snowboarding.

Snowboarding in fact uses a board having bindings for the boot, and the boot can be associated with the board with different orientations. Therefore, if the user, for example according to the particular competition he has to take part in, or according to specific individual requirements, wishes to change the orientation of the boot, this could certainly be done, but at the same time the resting condition of the leg and of the foot would be altered, possibly forming localized pressure regions that are uncomfortable for the user due to the single way of overlapping of the innerboot.

The stitching, or other applied elements, in fact prevents different mutual overlapping arrangements of the flaps.

SUMMARY OF THE INVENTION

The aim of the present invention is therefore to solve the described technical problems, eliminating the drawbacks of the prior art, by providing an innerboot for sports shoes having optimum comfort even if the user changes the normal resting condition of the leg and of the foot during sports practice, according to particular technical or personal requirements, such as the different orientation of the boot in snowboarding.

Within the scope of this aim, an important object is to provide an innerboot in which fit can be rapidly and easily adapted according to the specific orientation of the boot chosen by the user.

Another important object is to provide an innerboot which the user can customize to the desired comfort, and in a different manner between the foot and leg regions.

Another object is to provide an innerboot that has low manufacturing costs and that can be obtained with conventional apparatus.

This aim, these objects, and others which will become apparent hereinafter are achieved by an innerboot for sports shoes such as ski boots, roller skates, ice skates, shoes for climbing, shoes for snowboarding, characterized in that it comprises a first flap and a second flap, at least one end of each flap being free so that the first flap can overlap the second flap or vice versa.

Advantageously, said first and second flaps are constituted by a first portion and a second portion that are separate but contiguous and can be independently mutually overlapped.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
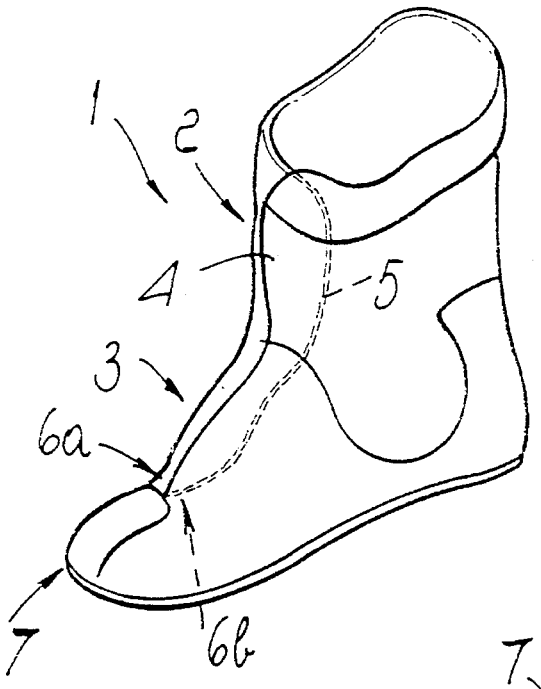
FIG. 1 is a view of a first embodiment of the invention, showing the first and second flaps mutually overlapped.

With reference to the above figures, the reference numeral 1 designates an innerboot usable in particular for sports shoes, such as for example ski boots, snowboarding boots, roller skates, ice skates, or climbing shoes. Said innerboot has, preferably in the front tibial region 2 and in the instep-metatarsal region 3, a slit forming a first flap 4 and a second flap 5 that can partially mutually overlap.

Figure 2:
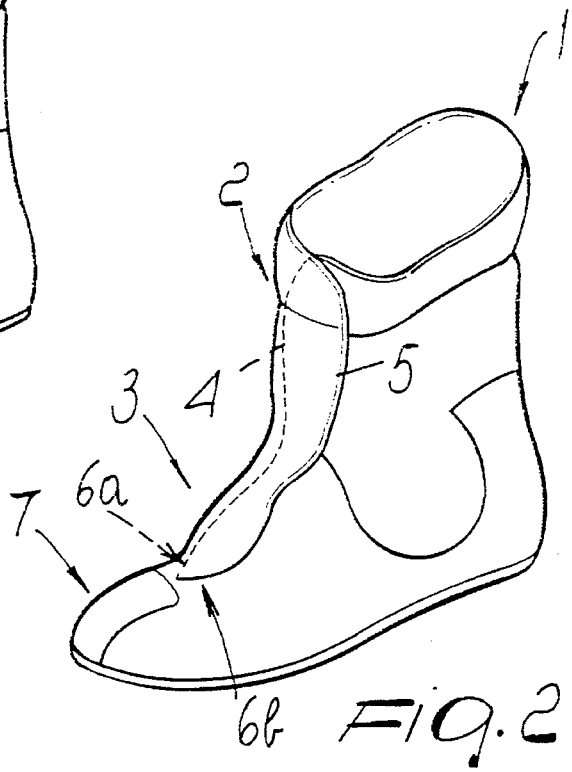
FIG. 2 is a view, similar to the preceding one, of a different overlapping condition of the first and second flaps.
Figure 3:
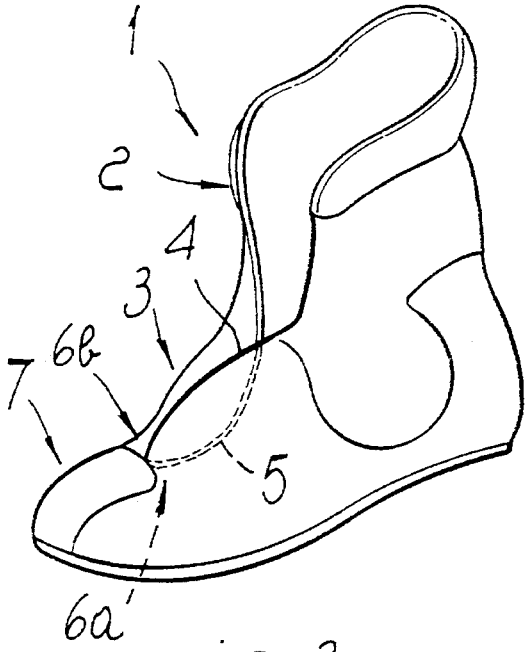
FIG. 3 is a view, similar to FIG. 1, of a second embodiment of the invention.
Figure 4:
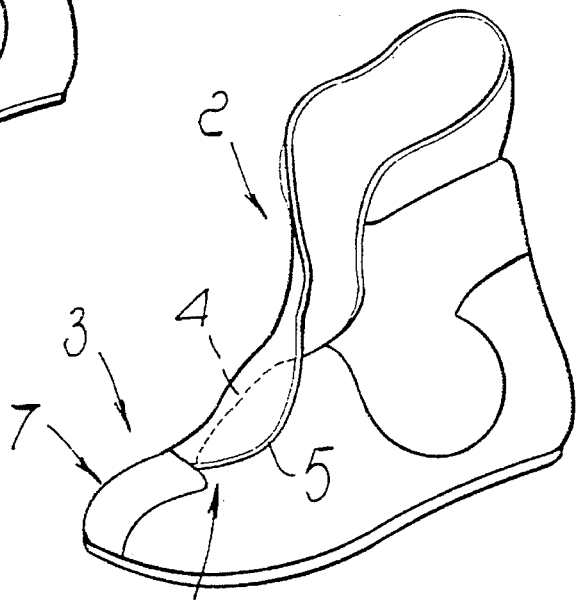
FIG. 4 is a view, similar to FIG. 2, of said second embodiment.

In FIGS. 1 and 2, said first and second flaps affect both the front tibial region 2 and the instep-metatarsal region 3, whereas in the embodiment shown in FIGS. 3 and 4 the first and second flaps affect only the instep-metatarsal region 3.

Said first flap 4 and said second flap 5 have tips, designated by the reference numerals *6a* and *6b*, that are mutually connected proximate to the toe region 7 without mutually overlapping in any way but so that they are free to allow independent overlapping movements between the first flap and the second flap.

Figure 5:
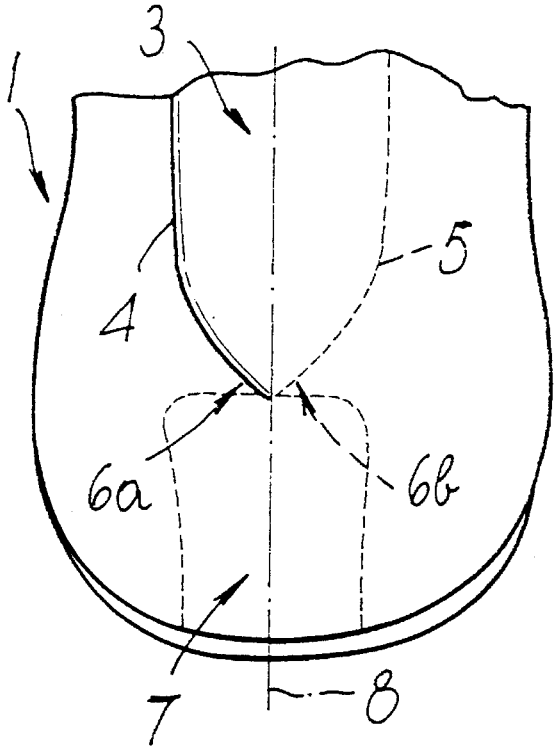
FIG. 5 is an enlarged top view of the toe region of the first embodiment where the tips of the first and second flaps join in the condition of FIG. 1.
Figure 6:
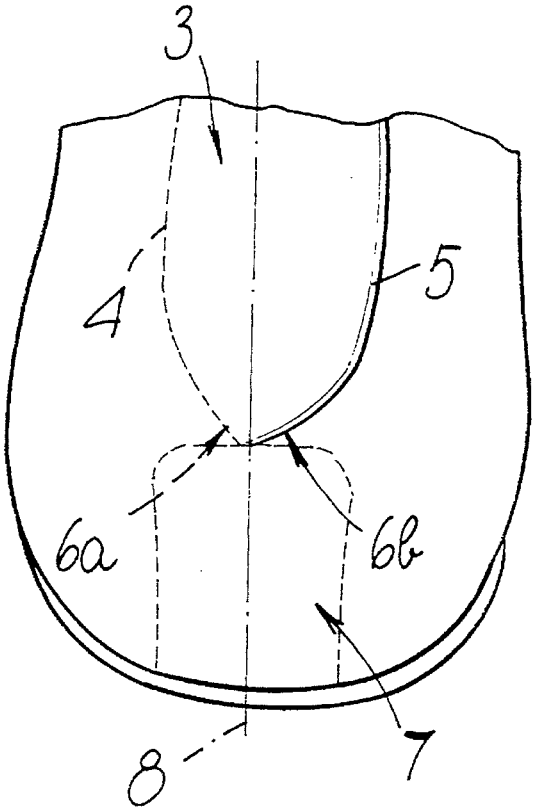
FIG. 6 is a view, similar to FIG. 5, of the first embodiment in the condition of FIG. 2.
Figure 7:
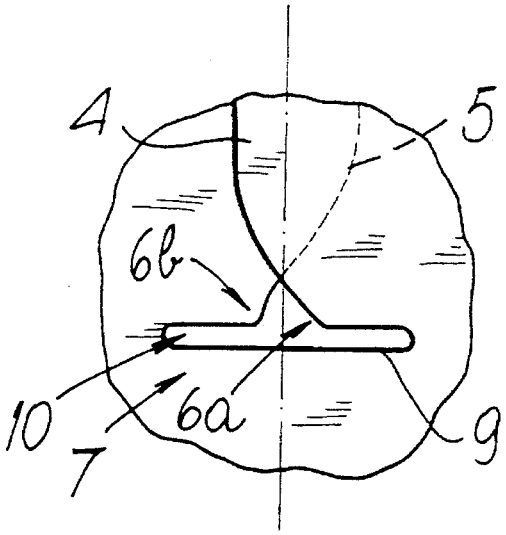
FIG. 7 is a detail view, similar to FIG. 6, of a further embodiment.
Figure 8:
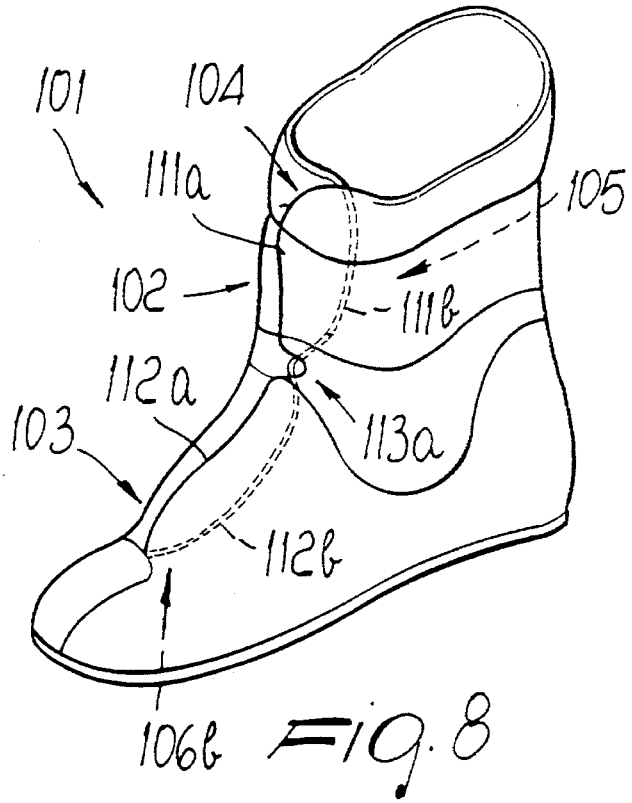
FIG. 8 is a view, similar to FIG. 1, of still a further embodiment.
Figure 9:
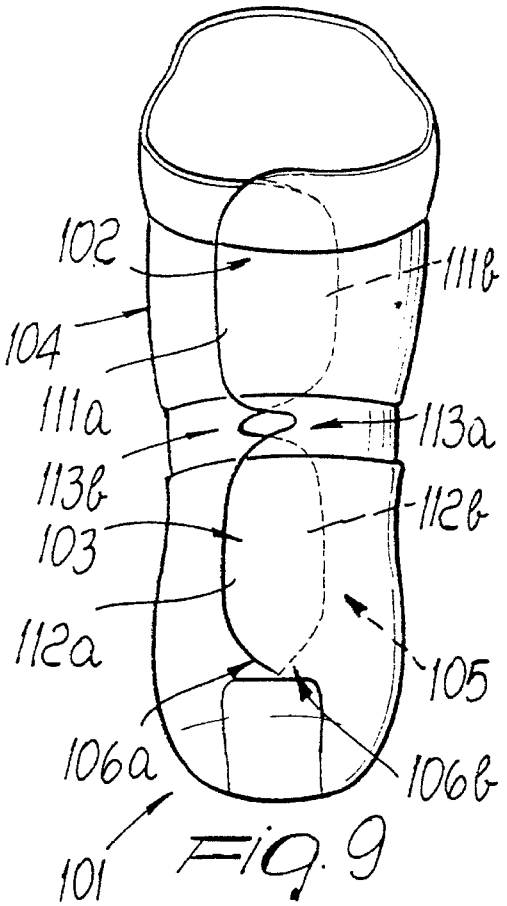
FIG. 9 is a front view of the embodiment of FIG. 8.
Figure 10:
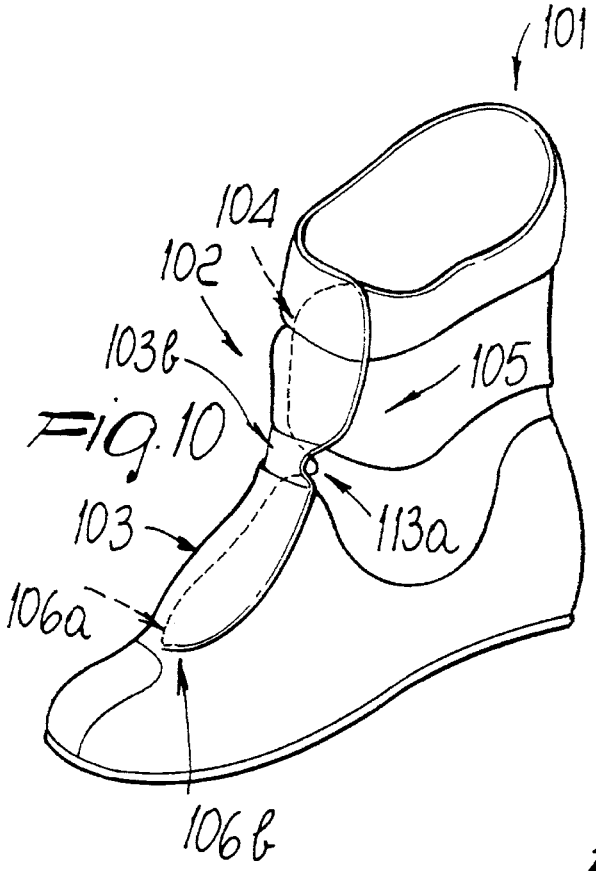
FIG. 10 is a view, similar to FIG. 8, of a different arrangement of the flaps.
Figure 11:
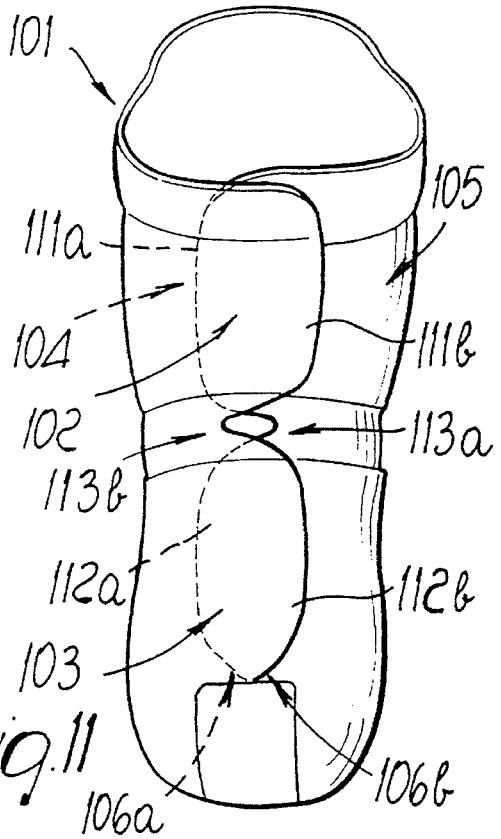
FIG. 11 is a view, similar to FIG. 9, of the embodiment of FIG. 10.
Figure 12:
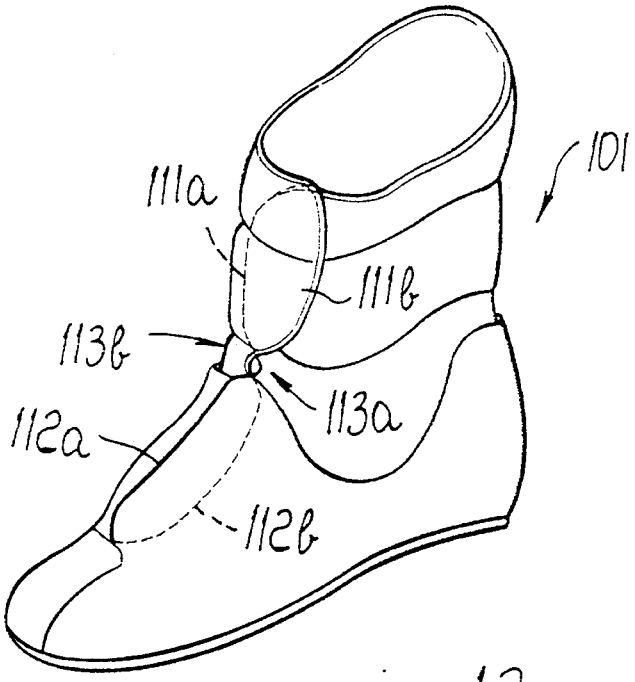
FIG. 12 is a view, similar to FIG. 8, of a further embodiment for the arrangement of the flaps.
Figure 13:
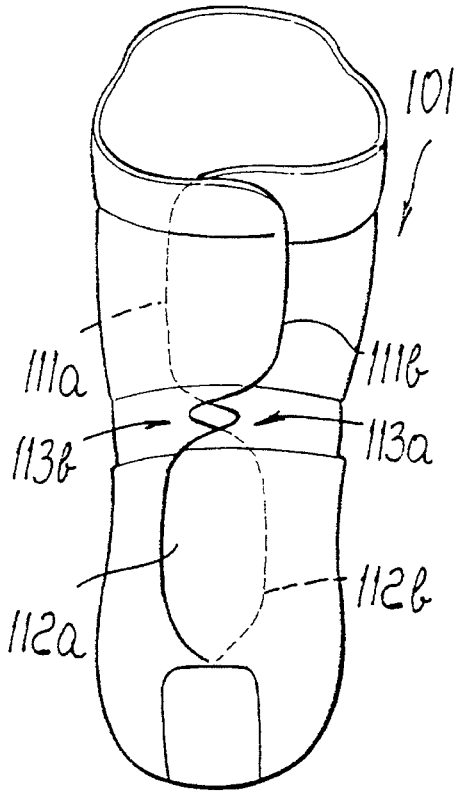
FIG. 13 is a view, similar to FIG. 9, of the embodiment of FIG. 12.

As shown in FIGS. 5 and 6, the tips 6*a* and 6*b* can be joined approximately at the central longitudinal plane 8 of the innerboot; as shown instead in FIG. 7, the tips 6*a* and 6*b* can be formed in points located approximately symmetrically with respect to said central longitudinal plane 8 at the edge 9 of an adapted slot 10 formed transversely with respect to the toe region 7.

This arrangement of the tips 6*a* and 6*b* allows to overlap the first flap over the second flaps or, vice versa, to place the second flap over the first one, as shown respectively in FIGS. 1, 4, 5, and 7 and in FIGS. 2, 3, and 6.

Accordingly, this allows to reverse the overlap of the first and second flaps, so as to allow the user to preset said overlap according to the orientation that is given for example to a boot in snowboarding.

It is thus evident that the invention has achieved the intended aim and objects, an innerboot for sports shoes, and particularly for snowboarding, having been provided that allows the user to reverse the overlap of the flaps according to the desired orientation to be given to the boot with respect to the board.

This reversal is very easy and quick to perform.

Said reversal can also be repeated without altering the characteristics of the innerboot and always allows optimum user comfort.

The innerboot according to the invention is of course susceptible of numerous modifications and variations, all of which are within the scope of the same inventive concept.

Thus, for example, FIGS. 8 to 15 illustrate another embodiment of an innerboot 101 in which the first flap 104 and the second flap 105 are each constituted by a first portion 111*a* and 111*b* that is adjacent to a second portion 112*a*, 112*b*.

The first portions 111*a* and 111*b* affect the front tibial region 102, whereas the second portions 112*a* and 112*b* affect the instep-metatarsal region 103.

The tips 106*a* and 106*b* of the second portions 112*a* and 112*b* of the first and second flaps do not mutually overlap and are free, as shown in the previous embodiment.

The first and second portions are mutually separated by means of an adapted recess, designated by the reference numeral 113*a* and 113*b*, that is formed transversely in a region that is intermediate between the front tibial region 102 and the instep-metatarsal region 103, preferably at the region affected during the forward flexing of the foot.

The particular shape of the first and second flaps, and therefore the forming of the first and second portions interrupted by the recess 113*a* and 113*b*, allow to obtain the desired mutual and/or alternating overlap of said first and second portions, as shown in FIGS. 8 to 15, thus offering the user a further choice for comfort.

FIGS. 16–19 show an innerboot 201 according to a further aspect of the invention.

The innerboot 201 is substantially similar to the innerboot 101 but for the instep region 203 which, in this case, is not covered by flaps.

Innerboot 201 is provided with first portions 211*a* and 211*b* at the tibial region 202, and with recesses 213*a* and 213*b*.

Portions 211*a* and 211*b* can be overlapped in two different manners, as illustrated in FIGS. 16, 17 and FIGS. 18,19 respectively, and as described above for innerboot 101.

Figure 14:
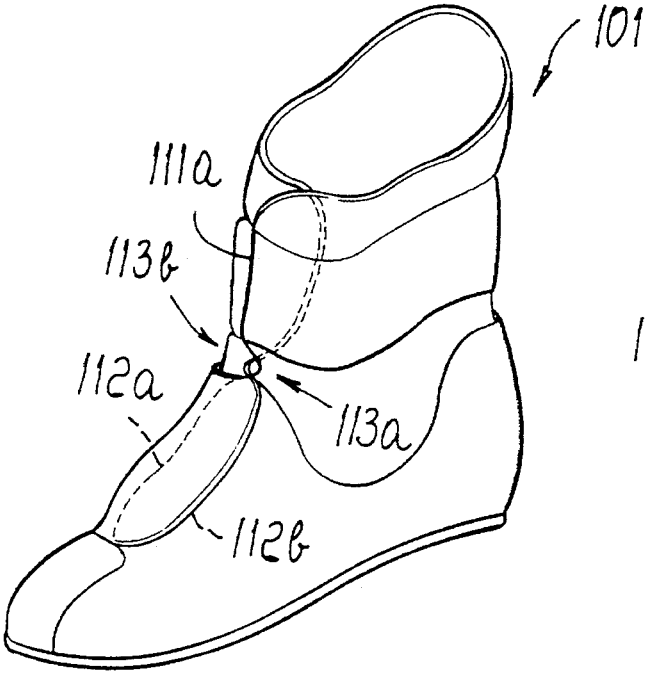
FIG. 14 is a view, similar to FIG. 8, of a further embodiment.
Figure 15:
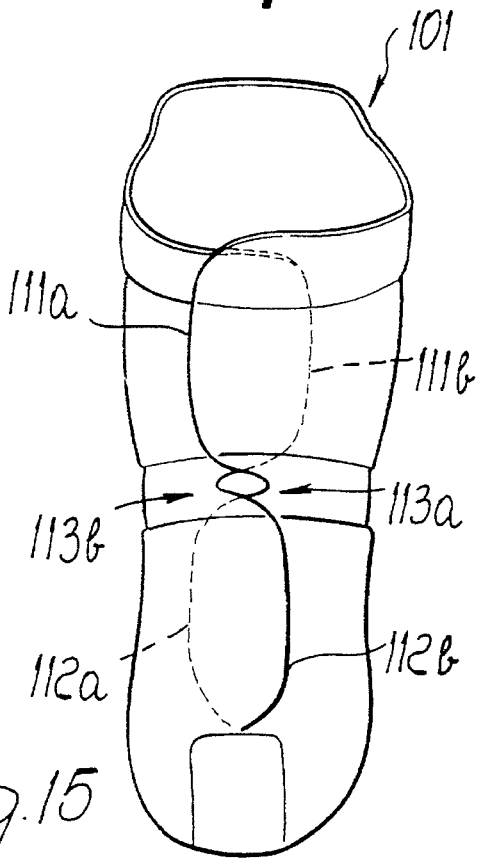
FIG. 15 is a view, similar to FIG. 9, of the embodiment of FIG. 14.
Figure 16:
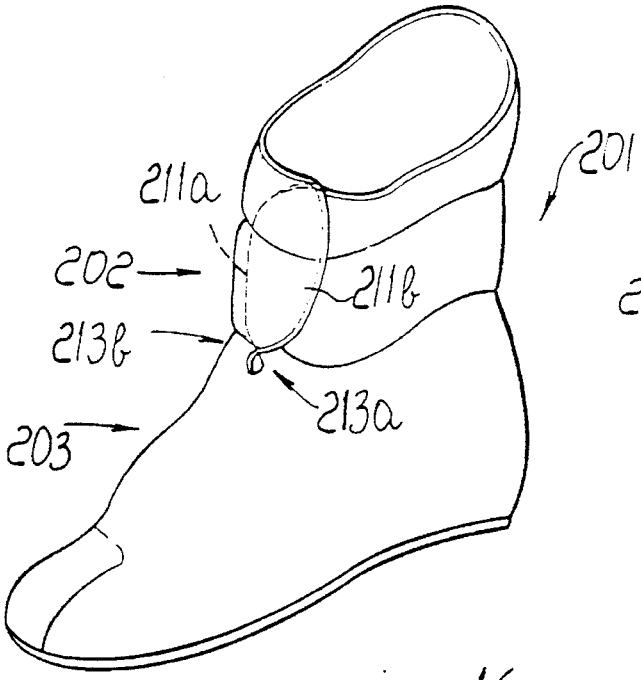
FIG. 16 is a side perspective view of the innerboot according to a further aspect of the invention.
Figure 17:
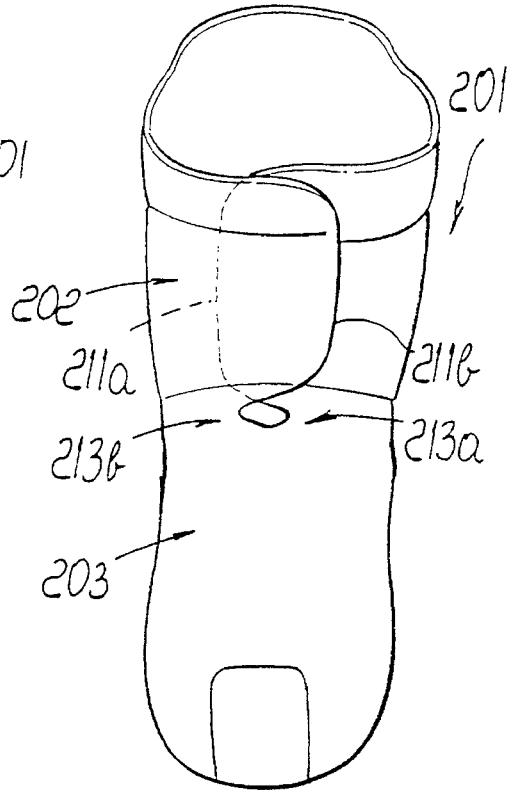
FIG. 17 is a front view of the innerboot of FIG. 16.
Figure 18:
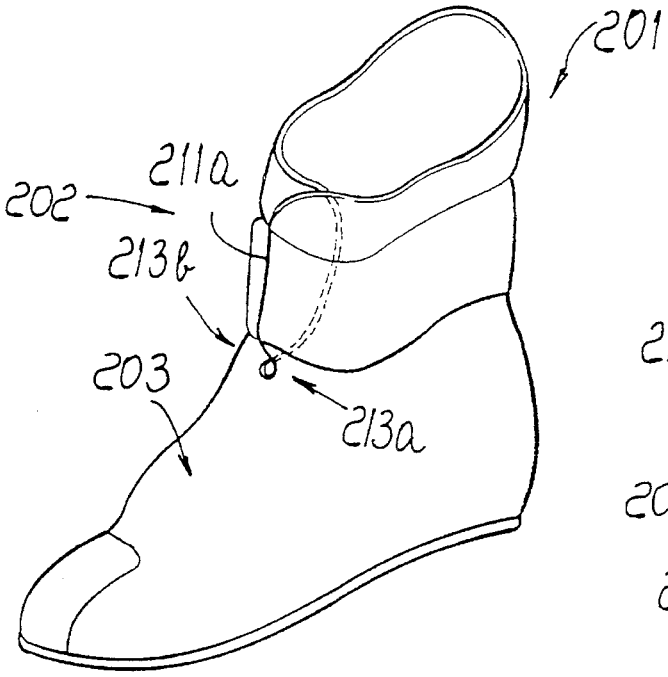
FIG. 18 is a side perspective view of the innerboot of FIG. 16 but with a different arrangement of the flaps.
Figure 19:
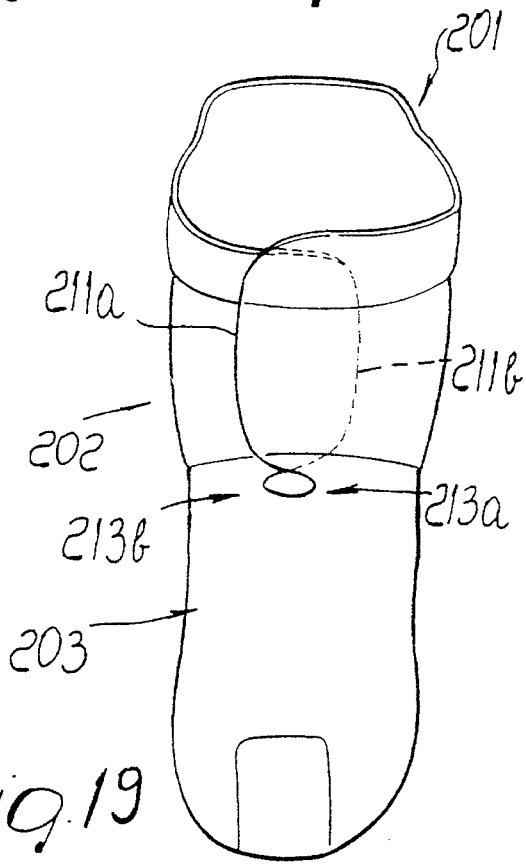
FIG. 19 is a front view of the innerboot of FIG. 18.
Figure 20:
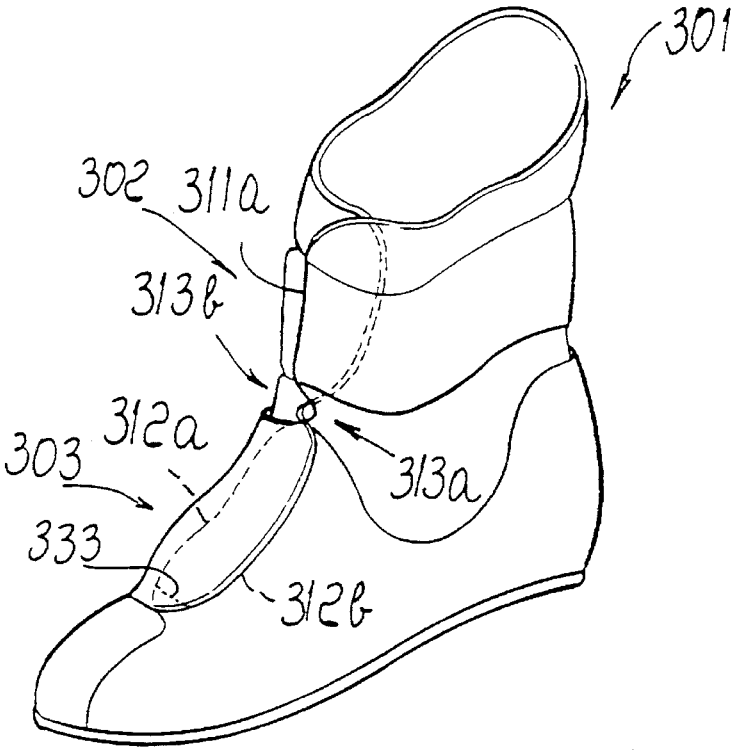
FIG. 20 is a side perspective view of the innerboot according to still a further aspect of the invention.
Figure 21:
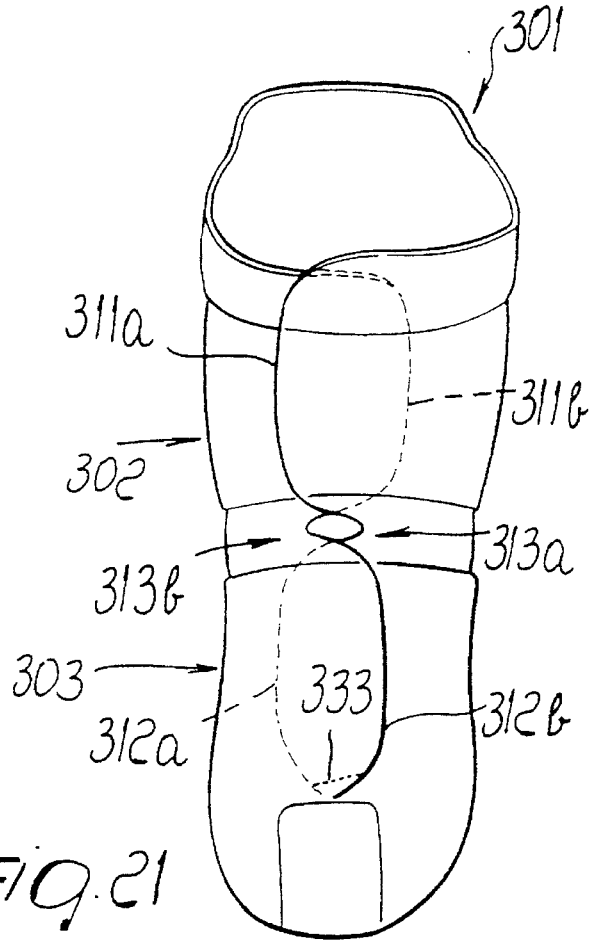
FIG. 21 is a front view of the innerboot of FIG. 20.

FIGS. 20,21 show an innerboot 301 according to still a further aspect of the invention. Innerboot 301 is very similar to innerboot 101, as illustrated in FIGS. 14,15 and described above. Innerboot 301 has a first portions 311*a* and 311*b* overlapping at the tibial region 302 and recesses 313*a* and 313*b*. Innerboot 301 also has second portions 312*a* and 312*b* overlapping at the instep region 303.

The outer overlapping portion 312*b* is connected to the body of the innerboot by a transversal stitching 333.

The materials and the dimensions that constitute the individual components of the innerboot, as well as the dimensions of the first and second flaps, of the first and second portions, and of the recesses, as well as their location, may of course be the most pertinent according to the specific requirements.

What is claimed is:

1. An innerboot for sports shoes having an inside for accommodating a user's foot, a lateral region, a medial region, a foot instep region, and a front tibial region, the innerboot comprising:

a first main portion extending, in a closed arrangement of the innerboot, at said lateral region and at said foot instep and front tibial regions;

a second main portion extending, in said closed arrangement of the innerboot, at said medial region and at said foot instep and front tibial regions;

wherein in said closed arrangement of the innerboot said first main portion and said second main portion mutually overlap substantially at said foot instep and front tibial regions, and wherein said first and second main portions have respective free edges such that the innerboot is openable into an open arrangement by moving at least one of said main portions to form an opening extending substantially at said foot instep and front tibial regions for permitting insertion and extraction of a user's foot into the inside of the innerboot; and wherein one of said main portions comprises a first flap portion arranged substantially at said front tibial region in said closed arrangement and a second flap portion arranged substantially at said foot instep region in said closed arrangement, a recess being provided in said one of said main portions extending between said first flap portion and said second flap portion such that one of said flap portions of said one of said main portions may be arranged over a first portion of the other main portion with respect to said inside of the innerboot in said closed arrangement and the other of said flap portions of said one of said main portions may be arranged under a second portion of the other main portion with respect to said inside of the innerboot in said closed arrangement.

2. The innerboot of claim 1 wherein said first flap portion is arrangeable over the first portion of the other main portion while said second flap portion is arrangeable under the second portion of the other main portion in said closed arrangement.

3. The innerboot of claim 1 wherein said second flap portion is arrangeable over the first portion of the other main portion while said first flap portion is arrangeable under the second portion of the other main portion in said closed arrangement.

4. The innerboot of claim 1 wherein the other main portion also comprises a first flap portion arranged substantially at said front tibial region in said closed arrangement and a second flap portion arranged substantially at said foot instep region in said closed arrangement, and a recess also being provided in the other main portion extending between the first and second flap portions thereof.

5. The innerboot of claim 4 wherein the first flap portion of said one of said main portions is arrangeable over the first flap portion of said other main portion while the second flap portion of said one of said main portions is arrangeable under the second flap portion of said other main portion in said closed arrangement.

6. The innerboot of claim 4 wherein the first flap portion of said one of said main portions is arrangeable under the first flap portion of said other main portion while the second flap portion of said one of said main portions is arrangeable over the second flap portion of said other main portion in said closed arrangement.

7. The innerboot of claim 4 wherein the recesses of said main portions are arranged for mutual interengagement in said closed arrangement of the innerboot and extend transversely with respect to said foot instep and front tibial regions at a forward flexing region of the innerboot.

8. The innerboot of claim 1 wherein both of said flap portions of said one of said main portions are also arrangeable respectively over both said first and second portions of said other main portion with respect to said inside of the innerboot in said closed arrangement.

9. The innerboot of claim 1 wherein both of said flap portions of said one of said main portions are also arrangeable respectively under both said first and second portions of said other main portion with respect to said inside of the innerboot in said closed arrangement.

10. A soft innerboot for insertion inside a rigid shell of a sports shoe, the innerboot having an inside for accommodating a user's foot, a lateral region, a medial region, a foot instep region, and a front tibial region, the innerboot comprising:

a first flap extending, in a closed arrangement of the innerboot, from said lateral region at said foot instep region;

a second flap extending, in the closed arrangement of the innerboot, from said medial region at said foot instep region;

a third flap extending, in the closed arrangement of the innerboot, from said lateral region at said front tibial region;

a fourth flap extending, in the closed arrangement of the innerboot, from said medial region at said front tibial region;

wherein in said closed arrangement of the innerboot said first and second flaps mutually overlap substantially at said foot instep region and said second and third flaps mutually overlap substantially at said front tibial regions, and wherein said flaps have respective free edges such that the innerboot is openable into an open arrangement by moving the flaps to form an opening extending substantially at said foot instep and front tibial regions for permitting insertion and extraction of a user's foot into the inside of the innerboot; and wherein a first recess is provided between said first and third flaps and a second recess is provided between said second and fourth flaps such that in said closed arrangement said first and second recesses mutually interengage and said first flap is arranged over said second flap with respect to the inside of the innerboot while said third flap is arranged under said fourth flap with respect to the inside of the innerboot.

11. A soft innerboot for insertion inside a rigid shell of a sports shoe, the innerboot having an inside for accommodating a user's foot, a lateral region, a medial region, a foot instep region, and a front tibial region, the innerboot comprising:

a first flap extending, in a closed arrangement of the innerboot, from said lateral region at said foot instep region;

a second flap extending, in the closed arrangement of the innerboot, from said medial region at said foot instep region;

a third flap extending, in the closed arrangement of the innerboot, from said lateral region at said front tibial region;

a fourth flap extending, in the closed arrangement of the innerboot, from said medial region at said front tibial region;

wherein in said closed arrangement of the innerboot said first and second flaps mutually overlap substantially at said foot instep region and said second and third flaps mutually overlap substantially at said front tibial regions, and wherein said flaps have respective free edges such that the innerboot is openable into an open arrangement by moving the flaps to form an opening extending substantially at said foot instep and front tibial regions for permitting insertion and extraction of a user's foot into the inside of the innerboot; and wherein a first recess is provided between said first and third flaps and a second recess is provided between said second and fourth flaps such that in said closed arrangement said first and second recesses mutually interengage and said first flap is arranged under said second flap with respect to the inside of the innerboot while said third flap is arranged over said fourth flap with respect to the inside of the innerboot.

* * * * *